US005855490A

United States Patent [19]

Hutchinson

[11] Patent Number: 5,855,490

[45] Date of Patent: Jan. 5, 1999

[54] WIRE CUTTING ELECTRICAL CONNECTOR HAVING TEST PROBE ACCESS

[75] Inventor: James David Hutchinson, London, Great Britain

[73] Assignee: The Whitaker Corporation, Wilmington, Del.

[21] Appl. No.: 952,165

[22] PCT Filed: May 22, 1996

[86] PCT No.: PCT/IB96/00481

§ 371 Date: Nov. 6, 1997

§ 102(e) Date: Nov. 6, 1997

[87] PCT Pub. No.: WO96/38883

PCT Pub. Date: Dec. 5, 1996

[30] Foreign Application Priority Data

May 30, 1995 [GB] United Kingdom ..... 9510886

[51] Int. Cl.[6] ..... H01R 4/26

[52] U.S. Cl. ..... 439/402; 439/392; 439/912; 324/538

[58] Field of Search ..... 439/587, 392, 439/402, 403, 409, 142, 912; 324/538, 555

[56] References Cited

U.S. PATENT DOCUMENTS

| | | | |
|---|---|---|---|
| 3,202,957 | 8/1965 | Leach | 439/392 |
| 3,611,262 | 10/1971 | Marley et al. | 439/392 |
| 3,793,612 | 2/1974 | Driscoll | 439/402 |
| 3,804,971 | 4/1974 | Bazille, Jr. | 174/88 R |
| 3,835,444 | 9/1974 | Plana et al. | 439/392 |
| 4,318,580 | 3/1982 | Fleisher et al. | 439/403 |
| 4,326,767 | 4/1982 | Silnernagel et al. | 439/392 |
| 4,444,448 | 4/1984 | Silbernagel et al. | 439/392 |
| 4,444,449 | 4/1984 | Aysta et al. | 439/401 |
| 4,496,206 | 1/1985 | Markwardt et al. | 439/409 |
| 4,891,018 | 1/1990 | Afflerbaugh et al. | 439/402 |
| 4,954,098 | 9/1990 | Hollingsworth et al. | 439/404 |
| 5,030,136 | 7/1991 | Reinhardt et al. | 439/460 |
| 5,067,910 | 11/1991 | Knox et al. | 439/402 |
| 5,080,606 | 1/1992 | Burkard | 439/403 |
| 5,120,246 | 6/1992 | Knox | 439/402 |

FOREIGN PATENT DOCUMENTS

| | | | |
|---|---|---|---|
| 0 095 307-A1 | 11/1983 | European Pat. Off. | H01R 4/24 |
| 0 096 484-A1 | 12/1983 | European Pat. Off. | H01R 4/24 |
| 2 047 984 | 12/1980 | United Kingdom | H01R 4/44 |
| 2 047 984 | 2/1983 | United Kingdom | H01R 4/44 |

OTHER PUBLICATIONS

PCT International Search Report (see PCT Publication).

*Primary Examiner*—Steven L. Stephan
*Assistant Examiner*—T. C. Patel
*Attorney, Agent, or Firm*—Driscoll A. Nina

[57] ABSTRACT

A wire connector (2) comprising a cover (8) and a body (4) for carrying a wires (84) therebetween. A U-shaped connection element (6) includes a first leg (48) for engaging a wire (84) positioned within the body (4) and a second leg (52) sharpened to sever the end of the wire (84), wherein the body (4) and the cover (8) include co-operating latch structure (30,32), to define an open position, where the wire (84) may be inserted into the connector (2) and a crimped closed position where the body (4) and the cover (8) are fully telescoped together whereby the excess end of the wire (84) is severed and the connector element (6) engages at the wire at the end connection slots (50). In the closed position, the connection element (6) is accessible in a manner that enables a test probe (78) to engage the connection element (6) through cover means (72) which is provided in a normally biased closed position and that is retained in the closed position without the need for latch means.

7 Claims, 4 Drawing Sheets

WIRE CUTTING ELECTRICAL CONNECTOR HAVING TEST PROBE ACCESS

BACKGROUND OF THE INVENTION

1. Field of the Invention

This invention relates to an electrical connector for electrically engaging at least one electrical conductor and severing the end thereof.

2. Summary of the Prior Art

There are numerous electrical connectors that perform a severing and a conductor engaging operation simultaneously during termination. Some examples are: U.S. Pat. No. 3,202,957; U.S. Pat. No. 4,326,767; U.S. Pat. No. 4,496,206; and U.S. Pat. No. 4,444,447.

In particular, U.S. Pat. No. 3,202,957 discloses a U-shaped connection element where the first leg of the U includes slot for engaging a wire in an insulation displacement (IDC) manner. The other leg of the U is sharpened such that it would cut the wire simultaneously with the termination by the first leg, whereby excess wire is removed and the wire is electrically engaged in response to a single movement of the connection element.

U.S. Pat. No. 4,326,767 discloses a wire connector having a body that carries a U-shaped connector element similar to that described above with reference to U.S. Pat. No. 3,202,957 and insulating cover that telescopes with the body in order to carry a wire into the connection slots of the connector element and against the sharpened second leg of the connector element to sever the end of the wire simultaneously with termination, wherein the body and the cover include co-operating latch structure to define an open position where wires may be inserted into the connector and a crimped closed position where the body and the cover are fully telescoped together whereby the excess end of the wire is severed and the connector element engages the wire at the connection slots thereof. It is further disclosed to include co-operating cover members to seal the end of the wire connector after the wire ends have been severed and displaced, thereby preventing contaminants from entering or sealing means, such as grease, from exiting. Finally, an inclined wall is provided in a supporting relationship with the sharpened blade of the connector element that ejects the wire and as the cover and body are telescoped together into the closed position.

While the afore mentioned connectors perform admirably it is desired to improve on a number of short comings. A first problem is with the co-operating cover members disclosed in U.S. Pat. No. 4,326,767. These cover members involve a door formed as part of the cover and having its normal bias as the open position. In order to close the door and thereby seal the connector unit a user must displace the door such that co-operating latch structure upon the door and another component of the wire connector. This leads to the possibility that the installer may forget to close the cover or that if the latch members become dislodged the cover will open. Another disadvantage of the afore mentioned connector structure is that it is difficult to test the continuity of the electrical interconnection. The typical method of doing so would be after the cover and body are fully telescoped together, such that the connector element is engaged upon the wire and the wire ends have been severed, using a probe to touch the second leg of the connector element where it is now exposed by the vacated wire end. A problem with this procedure is that in order to assure a clean severance of the wire end, a sharpened second blade must extend completely across the channel such that a test probe may only be brought against the sharpened second leg and must be held in physical contact therewith. This procedure is difficult for the installer as both hands must be involved in holding the connector and in holding the testing device. A further disadvantage occurs when it is necessary to test the continuity of the interconnection of the connector described above once the cover door has been latched in place. In this instance it is necessary for the installer to first pry the co-operating latch members apart such that the door may be opened to provide access to the sharpened second leg of the connector element. This could lead to damage of the latch members whereby the connector door could not be completely closed and latched in position.

Therefore, it would be advantageous to provide a connector of the type described above with a cover member that is normally biased to the closed position, thereby assuring the connector will remain sealed. Furthermore, it would be advantageous to maintain the closed position due to the elasticity of the hinge, thereby eliminating the need for co-operating latch members such that the cover means may be easily opened for later testing or access.

It would be advantageous to provide an electrical connector as generally described above with an access port that provides access to the U-shaped connector element in a manner that enables a test probe to engage and be positively retained with the connector element therein. It would be especially advantageous to include this access beneath the cover means that are used to cover the channels after removal of the severed wire ends.

SUMMARY OF THE INVENTION

The aforegoing objects are met by providing a connector according to claim 1. Additional advantageous developments are realized through connectors according to the subsequent dependent claims.

DETAILED DESCRIPTION OF THE PREFERRED EMBODIMENT

Figure 1:
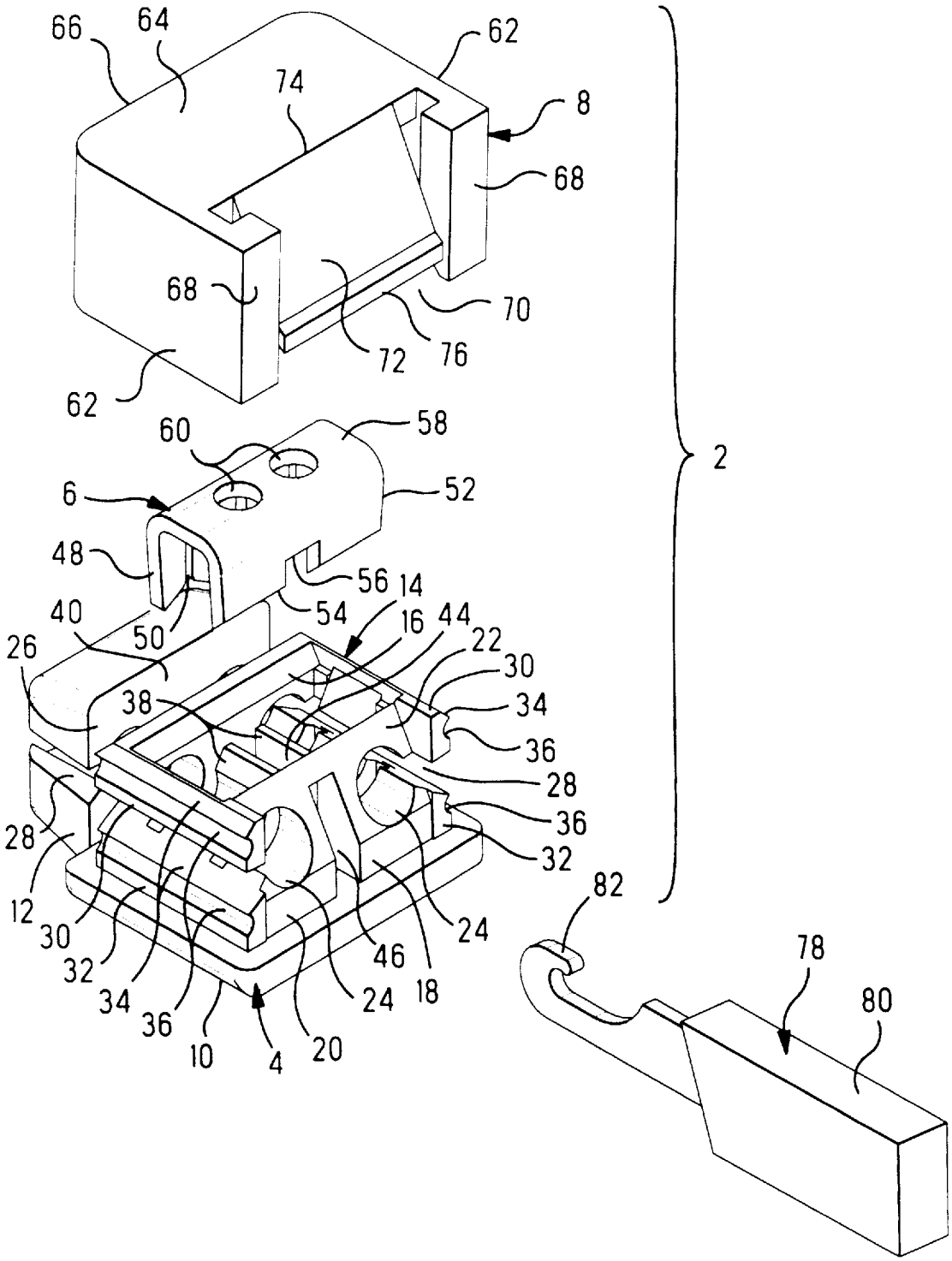
FIG. 1 is an exploded perspective view of an electrical connector according to the present invention and including a representation of a test probe.
Figure 2:
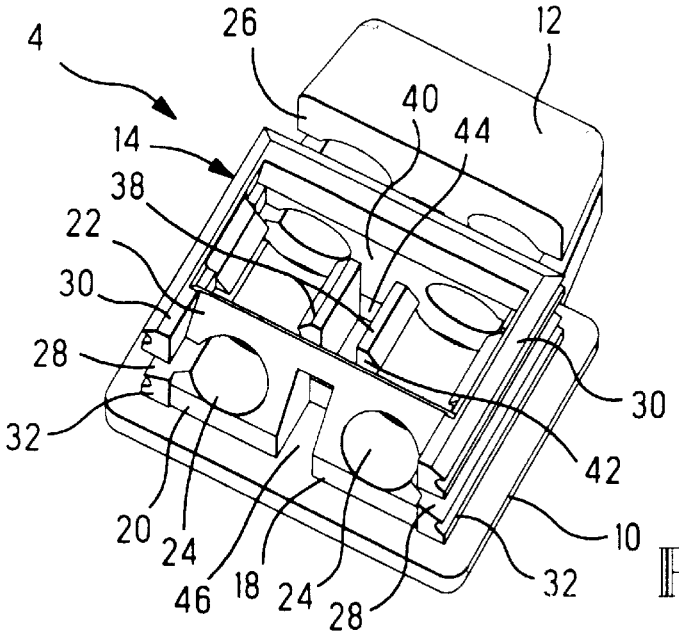
FIG. 2 is an upper perspective view of the body of the electrical connector of FIG. 1.
Figure 3:
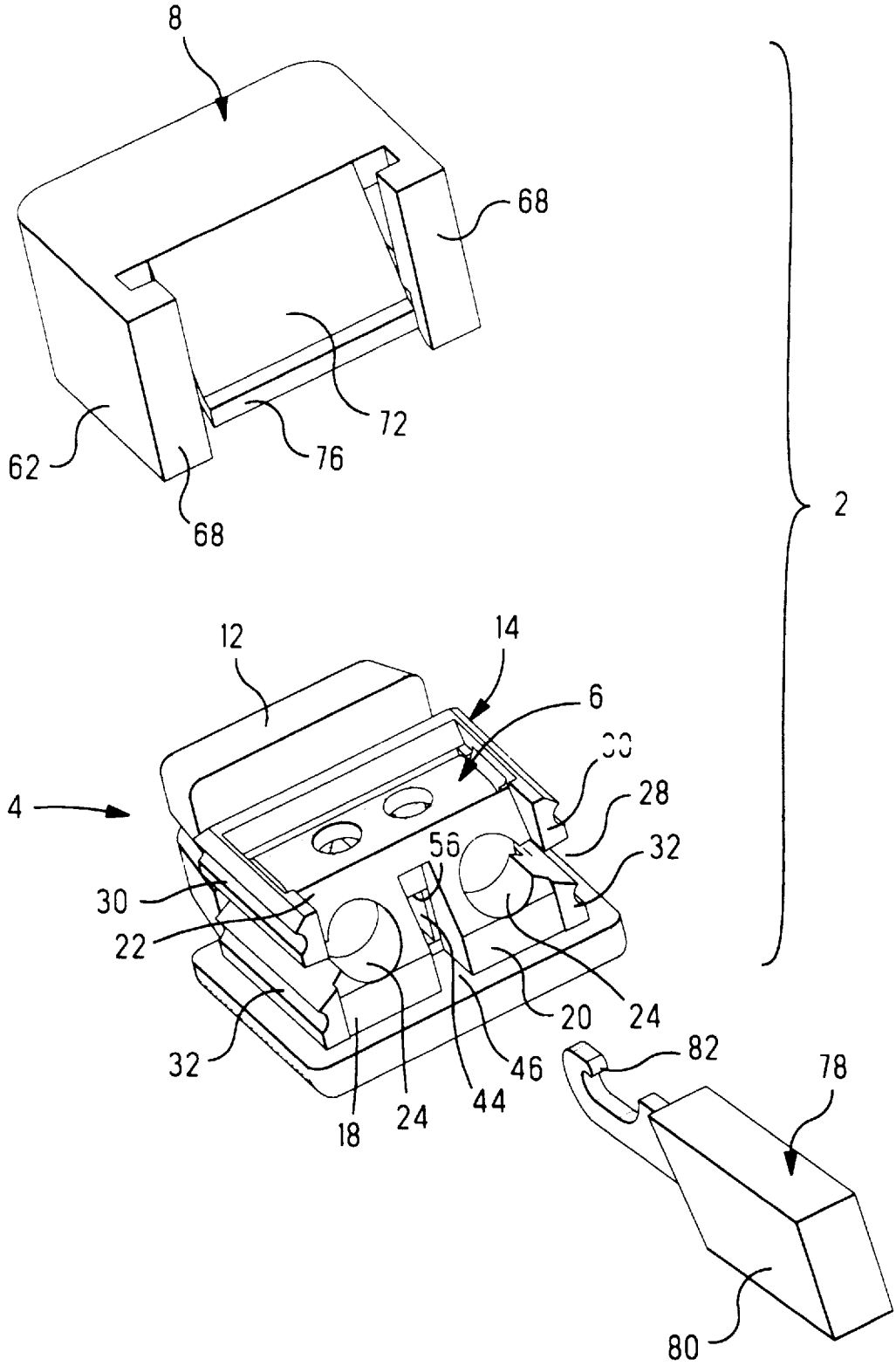
FIG. 3 is a partially exploded rear perspective view of the electrical connector of FIG. 1 showing the U-shaped connector element within the body.

With reference first to FIGS. 1–3, an electrical connector according to the present invention is shown generally at 2. The electrical connector 2 includes a main body 4, a U-shaped connecting element 6 and a cover member 8. The main body 4 includes a base 10. Extending from the base 10 is a nose portion 12. Located upon the base 10, is wire positioning structure 14. The wire positioning structure 14 includes a forward abutment 16 and a rearward abutment 18. The rearward abutment 18 comprises a vertical surface 20 extending upward from the base 10 and an inclined sealing surface 22. A pair of wire receiving channels 24 extend through the abutment 16,18 of the wire positioning structure 14 and across a gap 26 between first abutment 16 and the nose 12 where the channels 24 then pass through the nose portion 12. Each of the channels 24 are open on one side thereof by slots 28 such that the channels 24 have a C-shaped cross-section, which enables the necessary resilience of the structure. Spanning the abutment walls 16,18 are first and second positioning rails 30,32 respectively. The pairs of first positioning 30 are separated from the pair of second positioning rails 32 by the corresponding slots 28. Each of the positioning rails 30,32 include a tapered camming surface 34 followed by a scalloped seat 36. The tapered lead-in surfaces 34 and the scalloped seats 36 co-operate with a rib (not shown) within the cover member 8 to define a preassembled position where wires may be inserted into the connector 2 when the connector cover 8 is telescoped over the body 4 the rib passes over the camming surfaces 34 of the first positioning rail 30 to be received within the scalloped seats 36 thereof. Once disposed within the scalloped seats 36, sufficient force must be exerted to further telescope the cover 8 relative to the body 4 such that wire termination occurs as described below. When adequate force has been exerted the ribs come out of the scallop seat 36 of the first rails 30 and pass thereover and into the slots 28 and then come in contact with the camming surface 34 of the second rails 32. Further exertion of force results in the camming surfaces 34 causing the ribs to bias outward and enter scallop seats 36. The second rails 32 to define the fully closed position wherein the wires will be electrically engaged by the contact member 6. Located between the abutment walls 16,18 along each of the channels 24 opposite the slots 28 are separation partitions 38. Each of the separation partitions 38 are separated from the abutment walls 16,18 by connector element receiving gaps 40,42 (FIG. 2). Located between the separation partitions 38 is a probe clearance region 44. An access port 46 extends through the second abutment wall 18 and is aligned with the probe receiving clearance region 44 in order to enable the test probe 78 to engage the connection element 6.

The connection element 6 (FIG. 1) is a U-shaped conductive element having a first leg 48 with at least one connection slot 50 configured to electrically engage a conductive element, such as an insulated wire, as a result of being displaced thereover. One particular example would be an insulation displacement contact configuration. Opposite the first leg 48 is a second leg 52 having a bevelled cutting edge 54 at its free end. A gap 56 is formed roughly at the centre of the free end of the second leg 52. The legs 48,52 are interconnected by a base 58. The base 58 includes a pair of holes 60 enabling the connection element 6 to be affixed to the cover member 8 by such means as heat staking a pylon (not shown) that would extend therethrough as is common in industrial practice.

The cover member 8 that would carry the connection element 6 and be telescopically received upon the body 4 is a generally hollow member having opposing sides 62 interconnected by a cover member 64 and a forward plate 66. Opposite where the opposing sides 62 meet with the forward plate 66 are a pair of end legs 68. The end legs 68 are separated by a gap 70 formed therebetween. A flap 72 is joined to the cover 64 along a seam 74, whereby an elastic hinge is formed having its natural or relaxed position such that the inclination of the flap 72 corresponds approximately to the inclination of the inclined wall 22 of the second abutment 18 for purposes of sealing the second abutment as will be described below. It may also be desirable to have the flap at an inclination greater than that of the inclined surface so that a resilient force would be exerted therebetween to assure the flap remains against the inclined surface. At the extreme end of the flap 72 is a rail 76 for manipulating the flap 72. The flap 72 is configured to fit between the legs 68 without interference therebetween. The flap 72 could also be deformable and joined to the cover member 8 along end legs 68 thereof.

A representative test probe is shown generally at 78. The test probe 78 includes a body 80 from which an advantageous hook-like member 82 extends. The hook-like member 82 may be spring loaded as is common in electrical measuring instruments. The access port 46 is sized to receive the hook-like member 82.

The cover 8 is telescopically received over the wire positioning member 14 such that the side walls 62 encompass the positioning rails 30,32 so that the ribs positioned along the inner surfaces of the side walls 62 may be engaged by the rails 30,32. With wires received within the channels 24 and extending beyond the second abutment 18, as the cover 8 is brought down the rail 76, the flap 72 will make contact with the wires. The interference between the rail 76 of the inclined flap 72 and the wires results in the flap being deformed outward between the legs 68 such that as the cover 8 is being brought down in a telescopic manner upon the body 4 the flap displaces further outward. When the cover 8 is moved from the reassembled position to the fully latched position the resilient hinge formed along seam 74 is elastically displaced as the wires are engaged in the slots 50 of the connection element 6. During this time the second sharpened leg 52 of the connection element 6 severs the ends of the wires which are supported within the portion of the channels 24 within the abutment wall 18. A combination of the support provided by the abutment wall 18 and the interference with the resilient flap 72 result in the wire ends being retained within the connector housing 2. Once the ribs of the cover 8 are received within the second positioning rails 32 the installer may remove the wire ends. The resilient flap 72 by way of the elasticity of the hinge 74 and the memory aspect of the material used results in the hinge with the cover 8 drawing the flap 72 against the inclined surface 22, thereby sealing the open channels 24.

Figure 4:
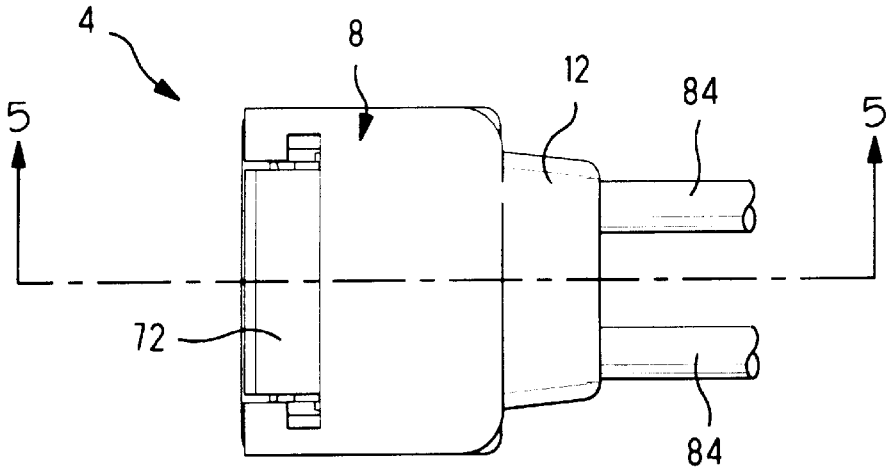
FIG. 4 is a top view of the electrical connector of FIG. 1 fully terminated upon a pair of wires.
Figure 5:
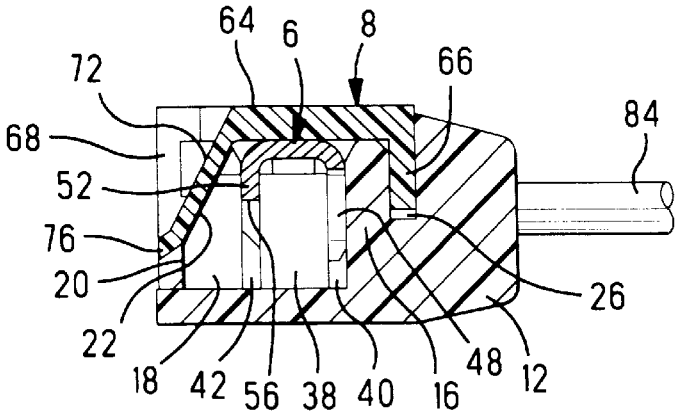
FIG. 5 is a cross-sectional view of the electrical connector of FIG. 5 taking along line 5—5.

With reference now to FIG. 4, the electrical connector 2 is shown fully terminated upon a pair of wires 84. The nose portion 12 encompasses the wires and provides strain relief thereto. The cover 8 has been telescopically disposed upon the body 4 and the flap 72 is shown in its natural position against the inclined surface of the second abutment wall 18. As can further be observed in FIG. 5, the rail 76 extends outward from the vertical portion 20 of the second abutment 18. Where it is desired to test the continuity of the electrical interconnection formed at the first leg 48, by lifting the flap 72 at rail 76 the test probe 78 may be inserted into the connector 2 by way of axis port 46, best seen in FIG. 6.

Figure 6:
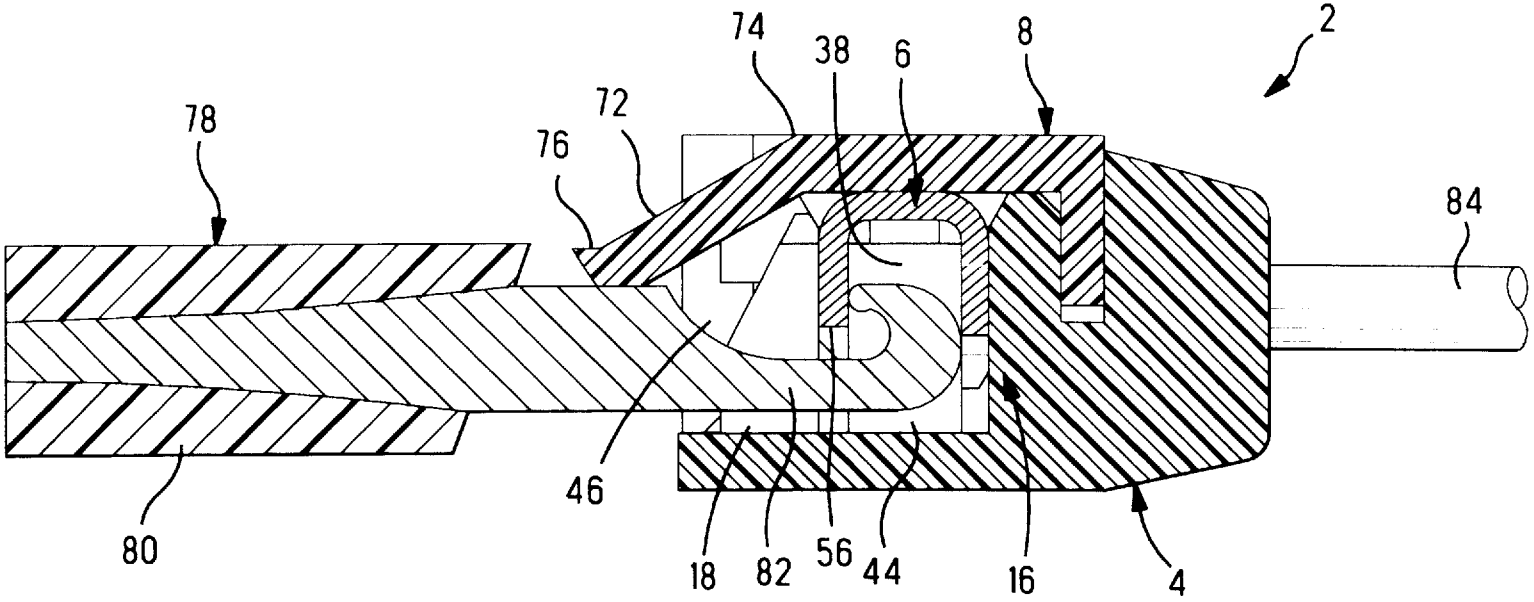
FIG. 6 is the same cross-sectional view of FIG. 5 with the representative test probe inserted within the access port.

With further reference to FIG. 6, the hook-like member 82 of the test probe 78 passes into the port 46 and, by way of the notch 56 behind the connection element 6 so that it may become engaged therewith to determine the electrical interconnection. As can be observed, the flap 72 may wedge against the body 80 of the test probe 78 to interfere therewith to assist in retaining the test probe in position. As is typical for test probes, the contacting portion 82 would be spring loaded and this interference would result in an advantageous, although not necessary positive engagement therebetween. It may also be possible for the test probe 78 to be engaged with other portions of the connector 2 structure.

We claim:

1. A wire connector comprising a cover and a body having a pair of channels for receiving respective wires therein, a connector element is positioned therebetween and includes a first leg for engaging the wires when positioned within the body in order to common said wires and a second leg sharped to sever an excess end of the wires, wherein the body and the cover have an open position where the wires may be inserted into the connector and a closed position where the body and the cover are fully telescoped together and latched together by cooperating latch structure where the excess end of the wires are severed and the connector element engages the wires, and sealing means are included for sealing an opening from which the excess wire ends are removed, the connector the body further includes an access port located behind the sealing means and extending into the body along the channels where the access port is in communication with the connector element such that the connector element is contactable by a test probe inserted into the access port and the sealing means is normally biased to the closed position.

2. The wire connector of claim 1, further characterized in that said sealing means is a flap that is joined to the cover through an elastic hinge such that the flap deforms upon telescoping of the body and cover as a result of interference with the excess end of the wire and the flap resiles to the sealed position upon removal of the interference.

3. The wire connector of claim 2, wherein the, the channels are separated by the access port.

4. The wire connector of claim 3, wherein the connector element includes a gap formed in the second leg thereof where said gap is aligned with the access port.

5. The wire connector of claim 1, wherein the cover has a latched first position upon the body where the wires can be received therein.

6. The wire connector of claim 1, wherein the connector element is U-shaped and affixed to the cover.

7. The wire connector of claim 6, wherein the connector element is of one piece construction.

* * * * *